US005401382A

United States Patent [19]

Katsuma

[11] Patent Number: 5,401,382

[45] Date of Patent: Mar. 28, 1995

[54] METHOD FOR FORMING TOUGH, ELECTRICAL INSULATING LAYER ON SURFACE OF COPPER MATERIAL

[75] Inventor: Kunio Katsuma, Chiba, Japan

[73] Assignee: Usui Kokusai Sangyo Kabushiki Kaisha, Ltd., Shizuoka, Japan

[21] Appl. No.: 206,182

[22] Filed: Mar. 7, 1994

[30] Foreign Application Priority Data

Mar. 9, 1993 [JP] Japan ..... 5-072861

[51] Int. Cl.[6] ..... C25D 11/34

[52] U.S. Cl. ..... 205/171; 205/333

[58] Field of Search ..... 205/171, 333, 149

[56] References Cited

U.S. PATENT DOCUMENTS 2,745,898 5/1956 Hurd ..... 174/120 SR
5,078,844 1/1992 Katsuma ..... 205/149

FOREIGN PATENT DOCUMENTS 633785 8/1991 Australia .
91 01965 2/1990 France .
58-31099 2/1983 Japan .
3-240999 10/1991 Japan .
1216257A 1/1983 U.S.S.R. .

*Primary Examiner*—John Niebling
*Assistant Examiner*—Brendan Mee
*Attorney, Agent, or Firm*—Lowe, Price, LeBlanc & Becker

[57] ABSTRACT

A method is provided for forming a tough, electrical insulating layer on a surface of a copper material. The copper material is made of copper of a copper-based alloy at least in the surface thereof. According to the method, the copper material is anodized first in an alkaline electrolyte bath of a caustic alkali to form a thin film layer of cupric oxide on the surface of the copper material, and next in an acidic electrolytic bath of a hexacyanoiron complex.

6 Claims, No Drawings

METHOD FOR FORMING TOUGH, ELECTRICAL INSULATING LAYER ON SURFACE OF COPPER MATERIAL

BACKGROUND OF THE INVENTION

1) Field of the Invention

This invention relates to a method for forming an insulating coating on a surface of a material whose surface is made of copper or a copper-based alloy, such as a wire, a stranded cable, a band, a tube, a pipe or the like (hereinafter called a "copper material").

More specifically, this invention provides a method for forming a uniform and tough, electrical insulating layer having excellent heat resistance on a surface of a copper material by anodizing the copper material in an alkaline bath as a first step and then anodizing the thus-treated copper material in an acidic bath of a hexacyanoiron complex as a second step.

2) Description of the Related Art

A variety of methods has heretofore been proposed for the formation of an electrical insulating coating layer (hereinafter simply called an "electrical insulating layer") on surfaces of various materials, including the following methods:

i) Covering or coating of an organic material:

For example, Scotch® tapes (product of 3M Co., St. Paul, Minn., U.S.A.) are made of a polyester, PTFE or polyimide material and use a thermosetting silicone rubber or an acrylic adhesive. Although they have an excellent withstand voltage (dielectric strength), their heat resistance is below 200° C.

ii) Covering or coating of an inorganic material:

Proposed coverings and coatings include, for example, flexible coverings formed by firing glass fibers in combination with an organic substance rather than simply applying glass fibers; and coatings obtained by applying inorganic polymers which contain boron, silicon and/or oxygen and can be converted to ceramics when fired. These coverings and coatings are however thick and costly so that their use for electronic devices and equipment reduced in dimensions and improved in precision is unsuitable.

Incidentally, as a simple and easy method for forming a reliable, electrical insulating layer, there is a method in which 0.1-mm thick mica is applied with an adhesive and inorganic powder. This method however involves problems, for example, in coil winding or the like because the covering thus applied has poor adhesion to the substrate. A limitation is therefore imposed on its practical utility.

iii) Different from the above described covering or coating of an organic material or an inorganic material, there are methods for directly forming an electrical insulating layer on a surface of a conductor.

These methods include, for example, formation of alumite (i.e., anodic oxidation coating of aluminum) and electrolytic deposition. These methods are both applicable only to those made of an aluminum-based material. When the degree of wire drawing becomes 0.5 mm or smaller in diameter, extreme difficulties are encountered and an increase in product cost is unavoidable. These methods therefore have poor practical utility.

(iv) Other methods have also been proposed, in which a copper material—which is one of best conductors and has workability such as wire drawability—is made electrically insulting at a surface thereof by chemical conversion or anodization. These methods however also have problems to be described below, so that their use in actual production is inhibited.

In such a chemical conversion as described above, a bath is prepared generally by adding a single alkali salt at a high concentration and an oxidizing agent, and a copper material to be treated is dipped at a high temperature in the bath so that a layer of cupric oxide (CuO) is formed on a surface of the copper material. This method however requires not only a long time for the chemical conversion but also a rather high cost for the reagents, and its productivity is therefore poor.

In the above-described anodization, an electrical insulating layer composed of cupric oxide (CuO) is formed on a surface of a copper material at a high current density in an alkaline solution of a high concentration in order to ensure high productivity.

This anodization involves the problem that, as cupric oxide thus formed is instantaneously redissolved even by a slightest variation in conditions (alkali concentration, current density), the process control is extremely difficult. Another serious problem of the above-mentioned anodization resides in that an anodized product must be washed thoroughly with water. When an alkali component remains on the product, large facilities, a lot of water and waste water treatment are required for the elimination of the alkali component. In view of these requirements, the anodization mentioned above is therefore considered to have poor practical utility. This water washing poses an especially serious problem when the product has a shape inconvenient for washing as in the case of a stranded cable, unavoidably resulting in extremely low productivity.

With a view toward overcoming the above-described drawbacks in the anodization of copper materials, there has been proposed an anodization method for a copper material in which plural alkaline baths are arranged in a linear pattern, the alkali concentrations of the individual baths are successively lowered in the travelling direction of the copper material, and the average anode current in each bath is lowered [Japanese Patent Application Laid-Open (Kokai) No. SHO 58-31099].

In the conventional anodization methods for copper materials including the improved anodization methods described right above, an electrical insulating layer formed on a surface of each copper material and composed of cupric oxide (CuO) has a large thickness and is weak against external strains so that it tends to develop cracks. Moreover, the heat resistance of the electrical insulating layer and its adhesion strength to the substrate are insufficient. For these reasons, the conventional anodization methods for copper materials cannot fully meet the stringent requirements for coils and the like that an extremely thin, heat-resistant, peel-free, electrical insulating layer must be surely formed.

(v) In the meantime, the present inventor made a new proposal in order to overcome the above-described drawbacks of the conventional techniques.

Namely, the present inventor proposed a novel method for forming on a surface of a copper material an electrical insulating layer composed of copper oxide and copper ferri(or ferro)cyanide, which comprises anodizing the copper material in a hexacyanoiron complex bath on an acidic to neutral side which is totally different from the conventional anodization making use of an alkaline bath [Japanese Patent Application Laid-Open (Kokai) No. HEI 3-240999; U.S. Pat. No. 5,078,844; French Patent No. FR 91 01965; Australian Patent (Acceptance) No. 633,785].

The above-described anodization proposed by the present inventor and making use of a hexacyanoiron complex can attain the primary object, that is, to form a rough, electrical insulating layer on a surface of a copper material. There is however room for further improvements, since a deterioration in the electrolytic bath and resulting variations in breakdown strength of formed electrical insulating layers are observed. Described specifically, the method proposed by the present inventor still has room for further improvements in order to apply it for the production of a copper material useful as a structural material having a tough electrical insulating layer on a surface thereof.

Incidentally, as a method for forming a colored decorative coating layer, more specifically a coating layer of a light brown to brown color on a surface of a copper material, it is known to use an anodizing electrolyte composed of an aqueous solution of potassium ferrocyanide [$K_4Fe(CN)_6$] [SU 1216257A (UKR LOCAL), see Derwent Abstract No. 86-283986/43]. This method is however different in nature from the method of the present invention which, as will be described subsequently herein, is to form a tough electrical insulating layer having a composite layer structure of a blackish brown color.

As described above, the novel method proposed by the present inventor and featuring anodization of a copper material in an acidic electrolytic bath of a hexacyanoiron complex is required to overcome problems such as a deterioration of the electrolytic bath and variations in breakdown strength of formed electrical insulating layers

OBJECT AND SUMMARY OF THE INVENTION

An object of the present invention is to overcome the above-described drawbacks of the conventional techniques and hence to provide a method for forming a uniform and tough, electrical insulating layer having excellent heat resistance on a surface of a copper material.

As a result of extensive research, the present inventor has found that the above object of the present invention can be achieved by anodizing a copper material in an electrolytic bath of a caustic alkali, especially in a high-temperature, alkaline electrolytic bath having a high alkali concentration prior to anodizing the same in the above-described acidic electrolytic bath of the hexacyanoiron complex.

In one aspect of the present invention, there is thus provided a method for forming a tough, electrical insulating layer on a surface of a copper material, said copper material being made of copper of a copper-based alloy at least in the surface thereof, which comprises:

(i) anodizing the copper material in an alkaline electrolyte bath of a caustic alkali to form a thin film layer of cupric oxide on the surface of the copper material; and (ii) anodizing the copper material, which has been anodized in step (i), in an acidic electrolytic bath of a hexacyanoiron complex.

The present invention has made it possible to extremely efficiently form a tough, electrical insulating layer on a surface of a copper material. The electrical insulating layer according to the present invention is different from conventional single layers made of copper oxide but is a thin composite layer composed in combination of copper oxide and copper ferri(or ferro)-cyanide. The composite layer firmly adheres to the copper base material so that it develops neither cracks nor separation in various working such as wire drawing, and moreover has excellent heat resistance.

Copper materials which have, on their surfaces, an electrical insulting layer of the excellent properties provided in accordance with this invention can therefore be used in a variety of fields.

In particular, reflecting the technological advancement, the improvements in precision and the reductions in dimensions of high-technology industrial equipment, it is now required to meet stringent use conditions. Electrical insulating layers according to this invention can successfully meet such requirements. For example, complex wiring, small-diameter coil winding and the like are required for various coils to be used in magnetic heads, VTR motors, stators, fan motors, etc. These requirements in turn require materials which remain substantially free from the influence of vacancy, porosity, temperature and the like. The present invention has also made it possible to effectively meet these requirements.

An electrical insulating layer formed on a surface of a copper material in accordance with the present invention is in the form of a thin film on the order or microns. Accordingly, this invention is effective for minimizing enlargement of wire harnesses and coil members such as solenoids and is also effective for producing ultra-fine wires for use in catheters.

DETAILED DESCRIPTION OF THE INVENTION

Technical features of the present invention will hereinafter be described in detail.

As has been described above, the present invention relates to an improvement in the method which was previously proposed by the present inventor for the anodization of a copper material in an acidic electrolytic bath of a hexacyanoiron complex.

According to the method previously proposed by the present inventor for the anodization of a copper material in an acidic electrolytic bath of a hexacyanoiron complex, the copper material is anodized using a neutral to weakly acidic bath of the hexacyanoiron complex.

The following drawbacks are however observed on the above method:

(i) $Cu^{2+}$ ions formed on a side of an anode in an initial stage of current feeding react with $OH^-$ ions adsorbed on a surface of the anode, whereby unstable $Cu(OH)_2$ is formed in accordance with the following formula:

$$Cu^{2+}+2OH^- \rightarrow Cu(OH)_2$$

The copper hydroxide deposited on the surface of the anode is unstable. As time goes on, it is therefore redissolved into a dark blue sol so that the electrolytic bath becomes turbid.

(ii) Further, owing probably to catalytic action of a copper metal surface of the copper material, soluble Prussian blue (potassium berlinate) $K[Fe^{2+}(CN)_6Fe^{3+}]$ is also formed in the form of a dark blue colloid at the same time. More Prussian blue is formed with time.

The above drawbacks (i) and (ii) are associated with each other to deteriorate the electrolytic bath. Concomitantly with this deterioration, electrical insulating layers are formed with varied breakdown strengths.

With the foregoing in view, the present invention includes technical measures to reduce the above-described dissolution of $Cu^{2+}$ ions and also to eliminate any copper metal surface.

Described more specifically, this invention has adopted the measure that, prior to anodization of a copper material in an acidic electrolytic bath of a hexacyanoiron complex, the copper material is subjected as a first step to anodization at a high temperature in an alkaline electrolytic bath containing a caustic alkali at a high concentration (may hereinafter be referred to as "the first electrolytic bath). Next, as a second step, anodization in the acidic electrolytic bath of the hexacyanoiron complex is conducted subsequent to the anodization in the first step.

The anodization of the copper material in the first electrolytic bath is to suppress excessive dissolution of $Cu^{2+}$ into the electrolytic bath due to an abrupt loss of the copper metal surface of the copper material, whereby the formation of colloidal blue $Cu(OH)_2$ as a contamination source of the electrolytic bath can be suppressed or prevented.

For the anodization of the copper material in the first electrolytic bath, it is therefore preferred to adopt such conditions that cupric oxide (CuO) in the form of a black film is promptly formed on the surface of the copper material.

In the initial stage of current feeding, $Cu^{2+}$ ions are dissolved out from the surface of the anode but, upon saturation, form a CuO film immediately. When the voltage increases further and more $Cu^{2+}$ ions are produced, the reaction proceeds until the electrolytic bath is saturated with $Cu(OH)_2$.

If the pH of the first electrolytic bath is strongly alkaline, i.e., has a pH of 12 or higher at this time, $Cu(OH)_2$ so formed is not dissolved but forms a stable film. If the temperature of the first electrolytic bath is high, for example, 80° C. or higher, $Cu(OH)_2$ so formed undergoes dehydration and turns to CuO in the form of a black film. In the first electrolytic bath, it is therefore preferred to conduct the anodization of the copper material at a high alkali concentration and a high temperature.

In the present invention, a great deal of gas is produced in the first electrolytic bath subsequent to the formation of cupric oxide in the form of a uniform dense film on the surface of the anode. The anodization in the first electrolytic bath can be completed at this time point.

Illustrative examples of the alkali substance employed to form the alkaline electrolytic bath can include caustic soda (NaOH) and caustic potash (KOH). Their thick solutions preferably have a concentration of 20 wt. % or higher.

Needless to say, an oxidizing agent can be added to the first electrolytic bath upon anodization of the copper material in the first electrolytic bath in accordance with the present invention.

Usable examples of the oxidizing agent include potassium persulfate ($K_2S_2O_8$) and sodium hypochlorite (NaClO). The oxidizing agent can be added generally at a concentration of 5–10 g/l.

According to the present invention, the copper material is subjected to anodization in an acidic electrolytic bath of a hexacyanoiron complex (may hereinafter be called "the second electrolytic bath") subsequent to the anodization in the first electrolytic bath (alkaline electrolytic bath). The anodization in the second electrolytic bath, that is, in the acidic electrolytic bath of the hexacyanoiron complex is substantially the same as the treatment by the method previously proposed by the present inventor. It is however necessary to adopt a higher voltage condition because the copper metal surface has been converted to copper oxide as a result of the anodization in the first electrolytic bath. A description will hereinafter be made of the anodization in the second electrolytic bath.

This invention uses, as the second electrolytic bath, an acidic bath of a hexacyanoiron complex. Hexacyanoiron complexes of this sort include hexacyanoferrates (II) and hexacyanoferrates (III). Specific examples include potassium ferrocyanide (potassium hexacyanoferrate (II), $K_4[Fe(CN)_6]$) and potassium ferricyanide (potassium hexacyanoferrate (III), $K_3[Fe(CN)_6)$.

It is for the following reasons that a hexacyanoiron complex is used as a principal component of an anodization bath in the present invention.

It is to promote the formation of a single-component layer (electrical insulating layer) of cupric oxide (CuO), which has been formed on the surface of the copper material by the anodization in the first electrolytic bath, and a hexacyanoferrate (II) or a hexacyanoferrate (III) into a composite layer that CN ions are caused to exist in the bath by using the hexacyanoferrate (II) or the hexacyanoferrate (III).

Use of a single salt of CN ions however results in an alkaline bath, leading to the greater potential problem that cupric oxide (CuO) may be dissolved again. To cope with this potential problem, the present invention uses the complex which renders the bath substantially neutral to acidic.

In the present invention, one of the following anodizing reactions is considered to proceed in the second electrolytic bath:

$$K_4[Fe(CN)_6]+Cu^{+}\rightarrow Cu_4[Fe(CN)_6] \quad (1)$$

$$K_3[Fe(CN)_6]+Cu^{+}\rightarrow Cu_3[Fe(CN)_6] \quad (2)$$

The copper ferrocyanide (1) or copper ferricyanide (2) so formed is progressively oxidized as the anodization proceeds, whereby it partly undergoes chemical conversion to cupric oxide (CuO). This change is considered to be attributable to the conversion of a portion of copper ferro(or ferri)cyanide, which has been formed in the beginning of the anodization, to cupric oxide (CuO) by [O] or $O_2$ occurred from the anode.

As has been described above, in the anodization in the second electrolytic bath according to the present invention, a single-component layer of black cupric oxide (CuO) is not formed on the surface of the copper material but a composite layer formed in combination of cupric oxide (CuO) and copper ferro(or ferri)cyanide is formed there.

For the formation of the composite layer, it is, needless to say, important to set adequate conditions for the anodization in the second electrolytic bath.

It is an essential requirement that the above-described acidic bath of the hexacyanoiron complex be used. To achieve efficient formation of a composite layer, it is also important to control a current at a lower level. As a rough standard, a current density (CD) not higher than 2 A/dm$^2$ is sufficient.

In the present invention, the anodization is preferably constant-current anodization. The anodizing time can be adjusted depending on the dielectric strength characteristics desired for an electrical insulating layer to be formed. As the anodizing time becomes longer, the compactness and thickness of the electrical insulating layer increase and, concomitantly with this, the anodizing voltage naturally increases.

In the anodization in the second electrolytic bath according to the present invention, special care must be exercised to reduce the generation of $O_2$ from the surface of the anode. Excess generation of such gas makes it difficult to achieve the object of the present invention. For the reasons mentioned above, the anodizing conditions are set to conduct constant-current anodization while maintaining the current density at 2 A/dm$^2$ or lower. A higher current density results in the generation of more gas, so that the formation of a film may be hampered or the film may be separated.

As conditions for the anodization in the second electrolytic bath according to the present invention, it is only necessary to conduct the anodization at the above-described current density, preferably at a complex concentration of 5–100 g/l and a pH of 3–8 for 10–15 minutes, more preferably at a complex concentration of 10–40 g/l and a pH of 3–7.5 for 10–15 minutes, most preferably at a salt concentration of 20–30 g/l and a pH of 6–7 for 12–13 minutes.

It is to obtain the resulting film in a barrier-type form instead of a porous form that, in the present invention, the pH is controlled at 3–8 in the anodization in the second electrolytic bath. When anodized in a strongly acidic solution as in general electrolytic baths, the resulting film is in the form of a porous film so that the electrolyte penetrates into pores of the film to cause chemical dissolution or oxidation. As a result, the performance of the film is deteriorated. If the electrolytic bath were strongly acidic or alkaline, once-formed copper ferricyanide, copper oxide and the like would be redissolved.

Another principal feature of the method of the present invention for the formation of an electrical insulating layer on a surface of a copper material resides in the structure of the composite layer formed on the surface of the copper material as the electrical insulating layer composed in combination of cupric oxide (CuO) and copper ferro(or ferri)cyanide.

As is observed in conventional anodized aluminum products, for example, a coating on an anodized aluminum wire has a double-layer structure composed of a thin barrier layer of aluminum oxide formed on a surface of the aluminum base or substrate material and a thick porous layer of porous aluminum oxide formed on the barrier layer and having the porosity of about 20%. The dielectric strength of the anodized aluminum wire is governed by the degree of the dielectric strength of air layers in the porous layer. As is well known, this porous layer is inherently brittle.

Compared with the structure of the coating of the above-described anodized aluminum product, the above-described composite layer in the present invention is extremely thin and can hence be considered to correspond to the barrier layer firmly adhered to the base material. According to a more microscopic observation of the composite layer of this invention, the composite layer is considered to have a multilayer structure such that the concentration of cupric oxide (CuO) is high in a region close to the surface of the base material, i.e., the copper material, the concentration of copper ferro(or ferri)cyanide is high in an intermediate region, and the concentration of cupric oxide (CuO) becomes gradually higher as the distance from the surface of the base material becomes greater.

The composite layer as the electrical insulating layer in this invention is formed by anodizing the copper material in an alkaline electrolytic bath as a first electrolytic bath and then in a bath of the particular complex as a second electrolytic bath and further by oxidizing copper ferro(or ferri)cyanide formed in an initial stage of the anodization in the second electrolytic bath, and has a structure absolutely different in nature from electrical insulating layers formed by conventional anodization techniques for Al or Cu materials.

EXAMPLES

The present invention will hereinafter be described in more detail. It should however be borne in mind that this invention is not limited to or by the following examples.

EXAMPLE 1

(i) Anodization in a first electrolytic bath:

An aqueous solution containing 450 g/l of NaOH was heated to 90° C. to provide the first electrolytic bath.

Next, 0.9 g (365 cm) of a copper wire having the diameter of 0.2 mm was wound into a coil (coil diameter: 6 mm). The coil was used as an anode, while a carbon electrode was used as a cathode.

The electrolytic system was operated at 2 V and 2 A/dm$^2$ for 80 seconds so that the coil was anodized.

The copper wire as the anode was evenly covered by a black CuO film and, then, furious generation of gas from the surface of the anode was observed. The anodization was stopped at that stage.

(ii) Anodization in a second electrolytic bath:

The anode (copper wire coil) was next transferred to the second electrolytic bath which will be described below, so that the anode was anodized.

An aqueous solution containing 20 g/l of potassium ferricyanide (red prussiate), $K_3[Fe(CN)_6]$, was prepared. HCl was added to adjust its pH to 6. The aqueous solution was then heated to 40° C. to provide the second electrolytic bath.

Anodization was conducted by controlling the current below the current density of 2 A/dm$^2$ while gradually increasing the current density within a range in which occurrence of gas such as [O] or $O_2$ from the surface of the anode was not observed to the eye (current density: 1–1.5 A/dm$^2$). During that anodization, the voltage increased to 30–35 V. The anodization was conducted for 12 minutes, whereby an electrical insulating layer having a dark brown color and the average thickness of 2.5 $\mu$m was formed.

After the anodization, the coil was unwound into a linear form. The electrical insulating layer underwent neither separation nor cracking. In addition, the coil was subjected to heat treatment for 10 minutes in a muffle furnace controlled at 400° C. The coil was similarly unwound into a linear form. Again, neither separation nor cracking was observed.

Using a withstand voltage tester ("Model TOS 8750", trade name; manufactured by Kikusui Electronics Industries, Ltd.), the dielectric strength of the electric insulating layer formed as described above was measured in accordance with the metal cylinder method prescribed in JIS C3003. Its dielectric strength was found to be 150 V. Incidentally, the wire not wound into the coil showed the dielectric strength of 600 V.

COMPARATIVE EXAMPLE 1

An experiment was conducted in a similar manner to Example 1 except that the anodization in the first electrolytic bath was omitted.

In this case, when the bath load arose to 5 Axhr/l, the bath gradually became darker from a green color to a bluish black color and its turbidity increased, so that the bath turned to a turbid bath.

In the case of Example 1 described above, however, the bath retained clarity although its color changed from a light yellow color to a slightly brownish yellow color, and subsequent anodization was still feasible.

There was no substantial difference in conducting resistance between the samples anodized in Example 1 and Comparative Example 1, respectively, when measured by a tester ("Model BX-505", trade name; manufactured by Sanwa Denki Co., Ltd.).

In a dielectric strength test by the metal cylinder method, however, a significant difference was observed between the sample of Example 1 and that of Comparative Example 1. Described specifically, the sample of Example 1 showed breakdown strength as high as 150 V at all locations in the coiled portion whereas the breakdown strength of the sample of Comparative Example 1 was as low as 50 V at many locations in the coiled portion.

COMPARATIVE EXAMPLE 2

The sample of Example 1 was tested using a chemical conversion solution which had been prepared by adding ammonium persulfate at the concentration of 5 g/l to an aqueous solution containing NaOH at the concentration of 150 g/l. The chemical oxidation was conducted by dipping the sample at 90° C. for 20 minutes in the chemical conversion solution. As a result, the resulting electrical insulating layer was found to have extremely insufficient adhesion. It was separated at many locations and many cracks were observed therein.

EXAMPLE 2

Using a cable obtained by stranding eight copper wires having the diameter of 0.1 mm and the length of 100 cm, anodization was conducted in a similar manner to Example 1 while using the first electrolytic bath and the second electrolytic bath. During the anodization, the current density (CD) increased from 1 A/dm$^2$ to 1.5 A/dm$^2$ while the voltage arose 30–35 V.

The anodization in the second electrolytic bath was conducted for 12 minutes, whereby an insulating layer having a dark, somewhat black, brown color was formed to the thickness of 2.5 $\mu$m on the surface.

The anodized cable was wound into a coil having the diameter of 4 mm. The insulating layer underwent neither separation nor cracking. Its heat resistance was exactly the same as the anodized wire obtained in Example 1.

Next, its conducting resistance was measured by the tester ("Model BX-505", trade name; manufactured by Sanwa Denki Co., Ltd.). The conducting resistance of 10 K$\Omega \times 10$ was indicated.

COMPARATIVE EXAMPLE 3

An experiment was conducted in a similar manner to Example 2 except that the anodization in the first electrolytic bath was omitted.

In a conducting resistance test, no substantial difference was observed between the sample of Example 2 and that of Comparative Example 3. In a dielectric strength test by the metal cylinder method, however, a significant difference was observed therebetween. Described specifically, the sample of Example 2 showed breakdown strength as high as 150 V at all locations whereas the breakdown strength of the sample of Comparative Example 3 was as low as 50 V at many locations.

I claim:

1. A method for forming a tough, electrical insulating layer on a surface of a copper article, said copper article having a surface which is made of copper or a copper-based alloy, said method comprising:

(i) anodizing the surface of the copper article in an alkaline electrolyte bath of a caustic alkali to form a thin film layer of cupric oxide on the surface of the copper article; and (ii) anodizing the surface of the copper article which has been anodized in step (i), in an acidic electrolytic bath of a hexacyanoiron complex.

2. The method of claim 1, wherein the alkaline electrolytic bath of the caustic alkali is a heated bath of aqueous caustic soda.

3. The method of claim 2, wherein the alkaline electrolytic bath comprises an aqueous NaOH solution which is heated to at least 80° C.

4. The method of claim 1, wherein the acidic electrolytic bath of the hexacyanoiron complex contains the hexacyanoiron complex at a concentration of 5–100 g/l and has a pH of 3–8.

5. The method of claim 1, wherein the acidic electrolytic bath of the hexacyanoiron complex contains the hexacyanoiron complex at a concentration of 5–100 g/l and has a pH of 3–8 and the anodization in step (ii) is conduced at a current density not higher than 2 A/dm$^2$.

6. The method of claim 1, wherein the copper article is selected from the group consisting of bands, rods, wires, stranded cables, tubes, and pipes.

* * * * *